US006672920B2

(12) United States Patent
Wilson

(10) Patent No.: US 6,672,920 B2
(45) Date of Patent: Jan. 6, 2004

(54) SCUBA DIVING FIN

(76) Inventor: Scot Morgan Wilson, 2383 Fairway Oaks Dr., Chula Vista, CA (US) 91915

( * ) Notice: Subject to any disclaimer, the term of this patent is extended or adjusted under 35 U.S.C. 154(b) by 0 days.

(21) Appl. No.: 10/222,430

(22) Filed: Aug. 16, 2002

(65) Prior Publication Data

US 2003/0036322 A1 Feb. 20, 2003

Related U.S. Application Data

(60) Provisional application No. 60/313,219, filed on Aug. 17, 2001.

(51) Int. Cl.[7] ..... A63B 31/08
(52) U.S. Cl. ..... 441/64
(58) Field of Search ..... 441/61–64; D21/806

(56) References Cited

U.S. PATENT DOCUMENTS 5,108,327 A * 4/1992 Klein ..... 441/62
6,129,601 A 10/2000 Aucoin
6,247,982 B1 * 6/2001 Walker ..... 441/64

OTHER PUBLICATIONS

Advertisement For Salomon Evolution 2 9.0 Ski Boot, Aug. 16, 2002.
Advertisement For Prosub Dive Boot Part No. SB6201, Aug. 16, 2002.

* cited by examiner

*Primary Examiner*—Stephen Avila
(74) *Attorney, Agent, or Firm*—Kenneth R. Wright

(57) ABSTRACT

The present invention relates to a scuba diving fin. The scuba diving fin utilizes adjustment mechanisms for the fin blade to be rotatably adjusted and locked in a first position that is in the same plane as the diver's leg and, alternatively, adjusted and locked in a second position behind the diver's calf. The present invention also utilizes a ski boot-type rigid outer shell, including the ski-boot style of clamping device used to close the boot around the diver's lower calf and ankle area. The present invention further utilizes a diver's neoprene bootie attached to the rigid outer shell to provide for a flexible lower boot portion. The fin blade first position is for diving and the second position is for walking or climbing steps.

20 Claims, 3 Drawing Sheets

SCUBA DIVING FIN

This application claims the benefit of Provisional Application No. 60/313,219, filed Aug. 17, 2001.

TECHNICAL FIELD

The present invention relates to the field of scuba diving. More particularly, the present invention relates to a scuba diving fin that improves the performance and comfort over known fins and permits the wearer to safely walk and climb steps while wearing fins.

BACKGROUND OF THE INVENTION

Known scuba diving fins are generally constructed as a one-piece polymer molding. These fins are configured to include a shoe section at one end where the diver places his foot. Attachment of the fin to the foot is either via a heel cup forming part of the shoe section or a strap attachment. From the toe-end of the shoe section extends the "fin." This configuration is undesirable for a number of reasons: 1) Due to the nature of attachment of the fin to the diver's foot and the method by which the fin is operated, there are significant forces applied to the diver's foot and ankle which result in diver discomfort and fatigue; 2) because the fin extends along the same plane as the diver's foot, the angle of the fin is not the angle best suited to optimal fin performance during use; and 3) due to the nature of construction of the fin, it is difficult and dangerous to walk and/or climb steps while wearing the fin (i.e., upon entry to or exit from the water). Currently, divers compensate for this third undesirable condition by either walking/climbing backwards into the water or attaching the fins after entry to the water. Both of these methods create their own dangers and challenges to the diver and are less than optimal.

Pivotable fins in various formats are known. These designs invariably seek to reduce the dangers attendant to walking while wearing traditional fixed fins. U.S. Pat. No. 6,129,601 to Aucoin, additionally provides for the fin section to be fixed behind the diver's calf, to reduce wind resistance while jumping into the water from helicopters, parachutes, and the like. However, known pivotable fins do not overcome or compensate for the traditional problems of diver fatigue or capitalize on the related performance benefits and a need has been identified for a diving fin that can be adjusted to fix the fin in the same plane as the diver's leg combined with a rigid ankle/lower calf assembly to strengthen the connection between the fin and the diver's leg, resulting in improved diving performance and reduced diver fatigue.

BRIEF SUMMARY OF THE INVENTION

The object of the present invention is to provide a diving fin that eliminates the problems associated with fatigue to the foot/ankle area during use and walking/climbing into or out from the water, and to improve fin performance.

The present invention provides for attachment of the fin to the diver's foot via a boot-type design, as opposed to the shoe-type design used presently. A boot allows the fin assembly to be attached to the diver's lower calf, ankle and foot. This boot can be fabricated using an inner boot section (similar to neoprene bootees already in use by divers), an inner liner made of high density foam (similar to liners commonly used in ski boots and/or in-line roller skates), combined with the ankle and calf sections of a boot shell to provide the necessary rigidity (similar to a modified in-line roller skate boot or ski boot type), and collectively referred to herein as the boot assembly. Such a boot assembly will effectively direct the forces encountered during operation of the fin to the leg instead of the foot/ankle. This improvement results in greater comfort and reduced fatigue to the diver, and also provides improved fin performance due to the more powerful "kick" made possible by attaching the fin to the diver's leg. The present invention further provides for an adjustable fin assembly comprising a fin blade and two fin arms. The fin arms connect to each side of the boot assembly at approximately the ankle axis via a mechanism that allows the fin arms to pivot about the ankle axis and to be locked in place at various positions therein (hereinafter, "fin adjustment mechanism" or "adjustment mechanism"). This adjustment mechanism allows the diver to lock the fin assembly in, among other positions, the dive position (i.e., where the fin is positioned in approximately the same plane as the diver's leg). This adjustment feature additionally allows the diver to unlock the fin from the dive position and to lock it in the walk position (i.e., where the fin section is rotated about the ankle axis to a position where it does not impede the diver from walking). The fin blade can also be removed from the fin arms for purposes of easier storage and interchanging fin styles, sizes, shape, colors, etc., depending upon the type of dive, conditions, preference of diver, style considerations, etc. The fin blade may also incorporate a carry handle. The present invention may be further understood by consideration of the following drawings and associated description.

BRIEF DESCRIPTION OF THE DRAWINGS

1.

2. FIG. 2 is a perspective view of the scuba diving fin, with the fin assembly attached to the boot assembly, with the fin assembly in the extended "dive" position; and.

3.

DETAILED DESCRIPTION OF THE INVENTION

Figure 1:
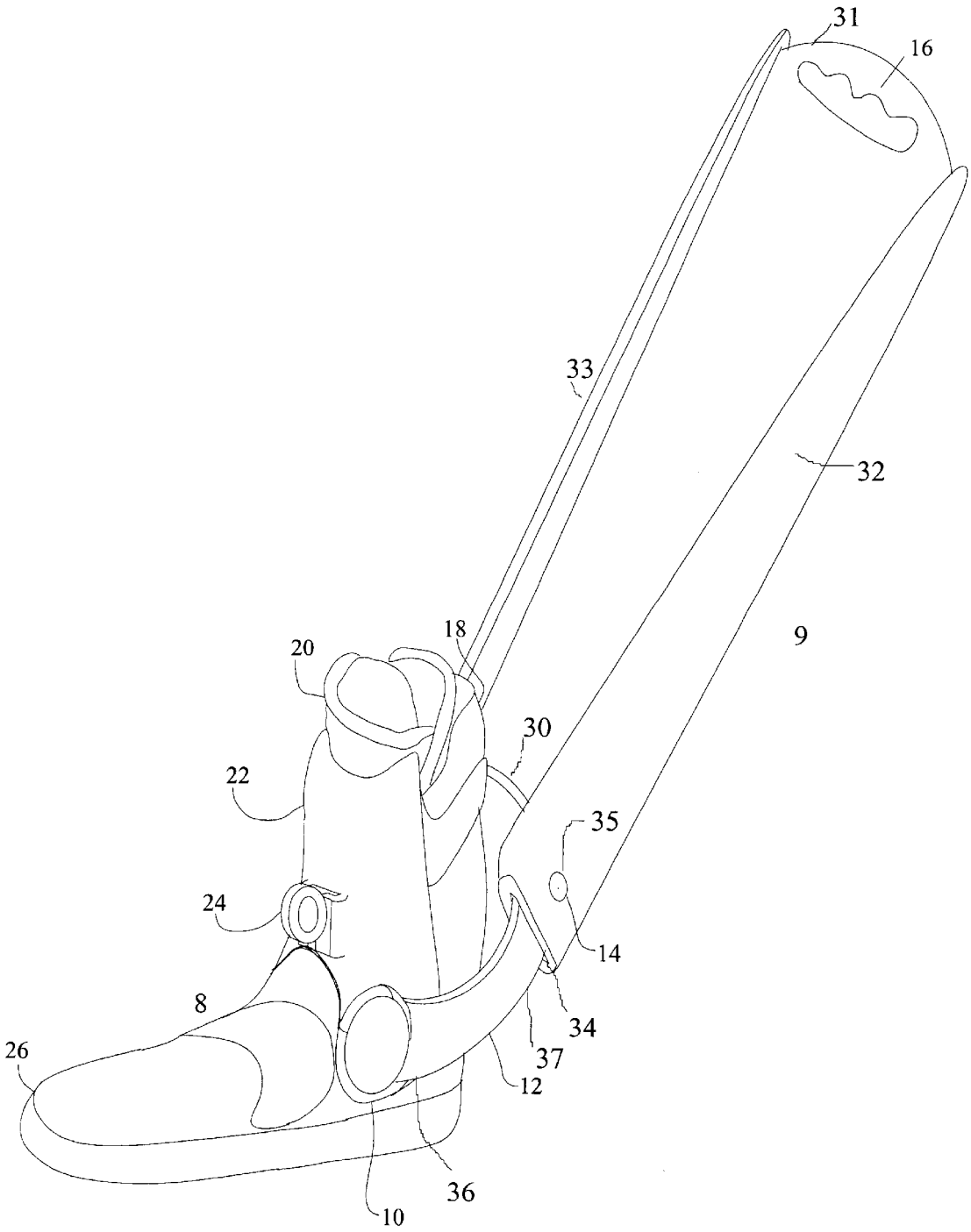
FIG. 1 is a perspective view of the scuba diving fin with the fin assembly attached to the boot assembly, with the fin assembly in the retracted "walk" position, illustrating the preferred embodiment of the invention.
Figure 2:
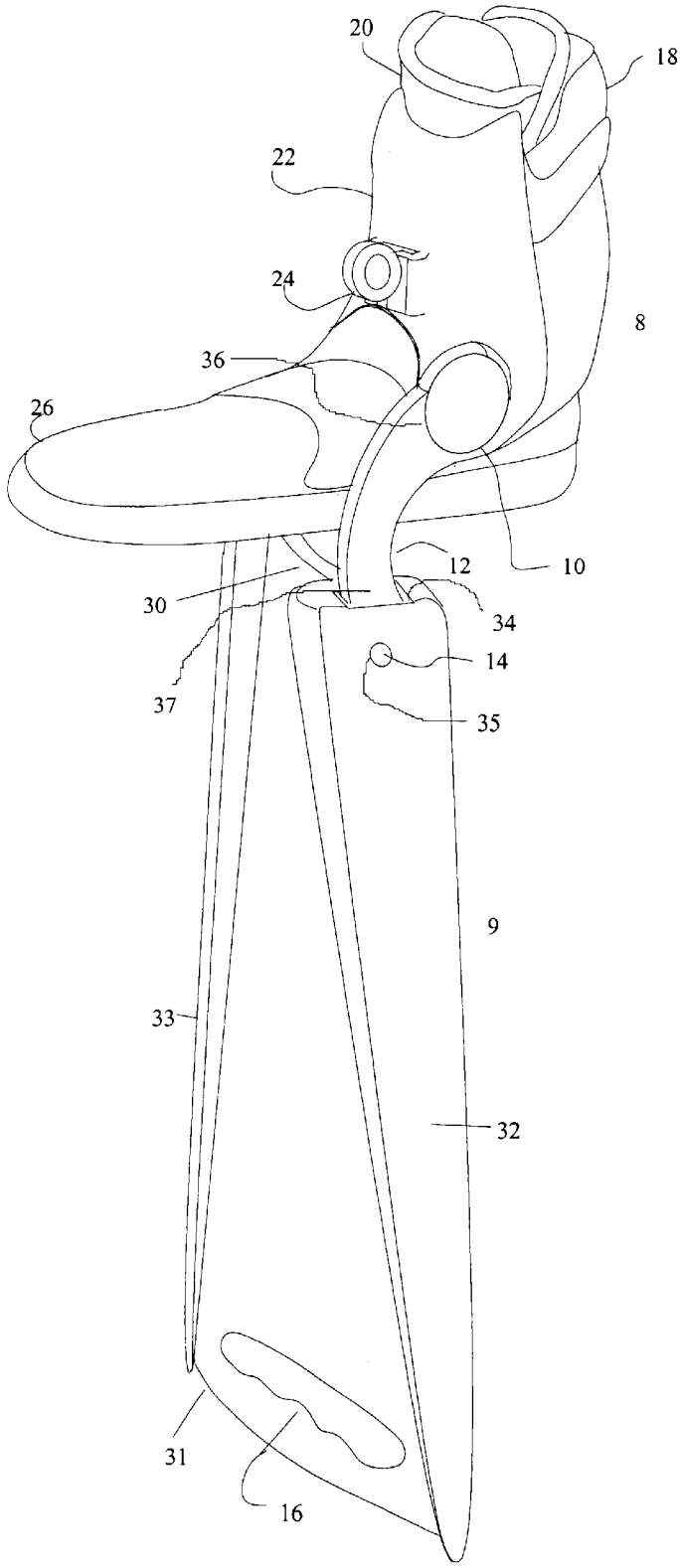

Referring to FIG. 1 or 2 of the drawings, the boot assembly (8) generally comprises a rigid rear shell with ski boot-type adjustable latch (18); rigid front shell (22); high density foam padding (20); and a flexible lower section (26). The fin assembly (9) generally comprises (two) fin arms (12); a detachable fin blade with integrated carrying handle (16); and (two) fin attachment devices (14). The fin adjustment mechanism (10) and fin position release mechanism (24) allow for adjustment, locking and unlocking of the fin assembly relative to the boot assembly.

FIG. 1 shows the preferred embodiment of the invention with the fin assembly (9) in the retracted "walk" position. FIG. 2 shows the preferred embodiment of the invention with the fin assembly (9) in the extended "dive" position. The components shown in FIG. 2 are the same components shown in FIG. 1. Either Figure may be used in connection with the following description of the preferred embodiment of the invention:

The Boot Assembly

The boot assembly (8) has a rigid rear shell (18) and rigid front shell (22) section to provide the necessary rigidity for calf-ankle support during operation of the invention. As previously indicated, the rigid shell sections are similar in design and function to the calf/ankle section commonly used in contemporary ski boot designs i.e., the present invention is similar to a ski-boot except that the present invention does not include the portion of the ski-boot that covers the skier's foot. An exemplar, to illustrate the calf/ankle support portion of the ski-boot design being utilized in the present invention, is Salomon Evolution 2 9.0, or any other ski-boot of this type, and is attached to applicant's Information Disclosure Statement, filed concurrently herewith. These rigid shell sections are made of a lightweight and rigid material such as carbon fiber, fiberglass reinforced nylon, plastic, or the like. Closure of the rigid shell sections is achieved utilizing the clamping designs and systems also commonly used for ski-boot closure, consisting of an adjustable latching system. Again, an exemplar is the latching system used on the Salomon Evolution 2 9.0, or any other ski-boot of this type. A high density foam padding-type material ("liner") (20) is semi-permanently attached to the inner surfaces of the rigid shell sections (18 and 22), via velcro or snaps, or some other semi-permanent means of attachment, to provide for boot sizing and comfort to the user during operation of the invention. Once again, the instant invention borrows from ski technology and the removable liner here is similar to the liners used in ski boots. The flexible lower section (26) is the scuba or dive bootie type already widely in use by divers and manufactured from neoprene with a rubber sole. An exemplar of the scuba bootie, to illustrate the flexible lower section being utilized in the present invention, is the ProScuba dive boot part no. SB6201, or any other dive boot of this type, and is attached to applicant's Information Disclosure Statement, filed concurrently herewith. The flexible lower section (26) is permanently attached with adhesive to the rigid shell sections (18 and 22) to provide insulation, safety, flexibility and comfort to the diver's foot during operation of the invention.

The boot assembly is worn by the diver placing his foot into the upper opening of the shell assemblies (18 and 22) and pulling the boot on until his foot is located within the flexible lower section (26). The diver then operates the ski boot-type adjustable latch or latches attached to the rigid shell sections (18 and 22) to "lock" the boot assembly on. Removal of the boot is the reverse of the method employed to put the boot on.

The Fin Assembly

Referring to FIG. 1 or 2, the fin assembly (9) generally comprises a fin blade (16) and two fin arms (12). The fin blade (16) has an outer contour generally in the form of a traditional fin blade and is manufactured from materials used for traditional fin blades, such as molded polymer. The fin blade (16) has a first end (30) and a second end (31), and a first longitudinal side (32) and a second longitudinal side (33). Located at either side of the fin blade first end (30) are longitudinal slots (34) that are each sized to receive a fin arm (12). A retaining hole (35) is located on each of the longitudinal sides (32 and 33) at a pre determined distance thereto and sized to receive a fin attachment device (14). Each fin arm (12) has a fin attachment device attached thereto (14).

In our preferred embodiment, the fin attachment device (14) is a spring-biased button attached to each fin arm (12). The fin attachment device (14) is sized to fit within the fin blade retaining hole (35) and is located on the fin arm to coincide with the fin blade retaining hole (35) when the fin arm second end (31) has been fully inserted into its corresponding fin blade longitudinal slot (34).

Figure 3:
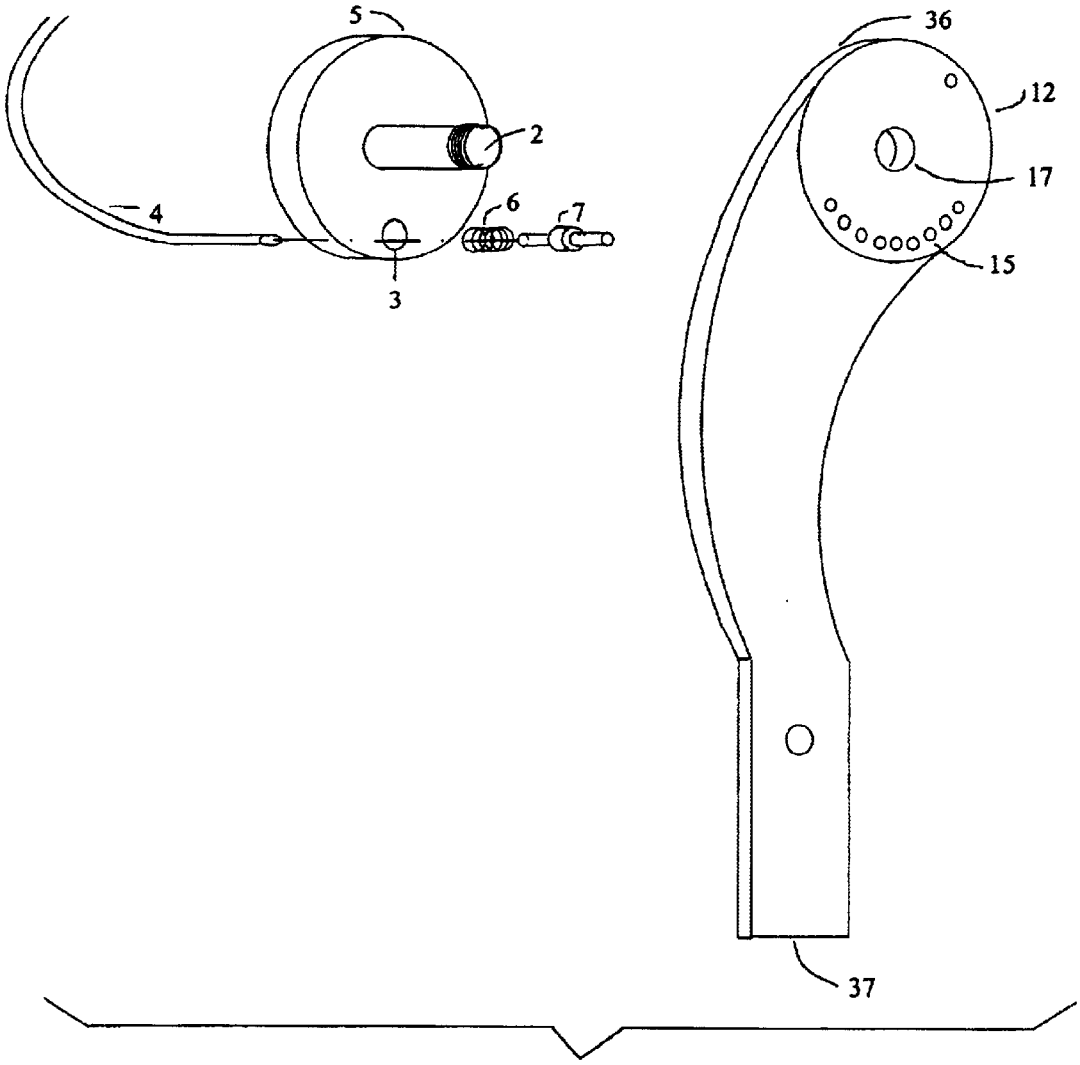
FIG. 3 is an exploded perspective view of the fin adjustment mechanism assembly.

Referring to FIG. 3, each fin arm (12) is rectangular in section and has a first end (36) and a second end (37). The first end (36) is semi-circular in profile. At the radius point (also known as center point) of the semi-circular first end (36) there is a first end pivot hole (17). Radial to the pivot hole (17) is a plurality of detent locking holes (15). The first end pivot hole (17) is sized to accommodate a close fit with the anchor pivot spindle (2). The detent locking holes (15) are sized to accommodate a close fit with the detent pin (7). The detent locking holes (15) are positioned radially about the pivot hole (17) in positions such that when the fin arm (12) is attached to the anchor pivot plate (5) via the anchor pivot spindle (2), one of the detent locking holes (15) will align with the detent retraction hole (3) when the fin assembly (9) is in the dive position, and another of the detent locking holes (15) will align with the detent retraction hole (3) when the fin assembly is in the walk position. The remaining detent locking holes (15) are located between the dive and the walk locations to allow additional adjustment to the fin assembly position relative to the boot assembly (8). The fin arm second end (37) is sized in section and in length to allow for insertion into its corresponding fin blade longitudinal slot (34) to a depth sufficient to provide the necessary support to the fin blade (16) during diving.

The Fin Adjustment Mechanism

Referring once again to FIG. 1 or 2, a fin adjustment mechanism (10) is located and permanently attached to each side of the boot assembly (8). The fin adjustment mechanisms (10) are positioned on an axis equal to the diver's ankle. The fin adjustment mechanism (10), provides means for the fin assembly (9) to be adjusted radially about the radial axis of the adjustment mechanism (10), so that the fin assembly (9) may be adjusted from the retracted "walk" position to extended "dive" position and visa-versa. The adjustment mechanism (10), also provides means for the fin assembly (9) to be locked in either the extended "walk" position (see, FIG. 1) or retracted "dive" position (see, FIG. 2), and then unlocked, so as the fin assembly position can be readjusted.

Referring to FIG. 3, in our preferred embodiment, this adjustment, locking and unlocking feature of the fin adjustment mechanism (10) is achieved by attaching an anchor pivot plate (5) permanently to the each side of the boot assembly (8), proximate to the diver's ankle. Please refer to FIG. 1 or 2 to observe the approximate location of the fin adjustment mechanism assembly (10) relative to the boot assembly (9). The anchor pivot plate (5) is a round disc made of a non corrosive material (as are all of the components to the present invention). The anchor pivot spindle (2) is round in section and has a first end and a second end. The pivot spindle (2) first end is permanently attached to the center of the anchor pivot plate outer disc face (5). The pivot spindle (2) second end is threaded. The anchor pivot spindle (2) is of sufficient length to extend beyond the outer facing surface of the fin arm (12) when the fin adjustment mechanism (10) is assembled. The assembly description is located in the section entitled, "Assembly and Operation of the Scuba Diving Fin", below. The anchor pivot spindle (2) is also of sufficient length when assembled to accept a locking nut (not shown) at its threaded end. When the locking nut is fully tightened to the anchor pivot spindle, it provides for a close fit between the contacting inner surface of the fin arm (12) and outer surface of the anchor pivot plate (5), such that these contacting surfaces can radially slide against one another with minimal lateral or axial movement.

The fin adjustment mechanism assembly (10) also provides for means to lock the fin assembly (9) in place, relative to the boot assembly (8), and unlock the fin assembly (9), so that it can be rotated and locked in a different position relative to the boot assembly (8). Referring to FIGS. 1 and 2, the fin assembly is locked and unlocked via operation of the means for fin position release mechanism assembly (24). In our preferred embodiment, the fin position release mechanism assembly (24) comprises a ring-pull located at the front of the boot assembly (8) that when pulled by the diver, (see, FIG. 3) operates retraction cables (4) connected to detent pins (7), which release the detent pins from the detent locking holes (15).

Referring to FIGS. 1, 2 and 3, the fin position release mechanism assembly (24) has two retraction cables (4). Each retraction cable has a first end and a second end. The retraction cable (4) first end is permanently attached to the ring-pull located at the front of the boot assembly (8), and each retraction cable (4) second end is permanently attached to one of two detent pins. The detent pin (7) has a first end and a second end. The detent pin (7) is of a design similar to commercially available detent pins. An exemplar of a detent pin is appended hereto in order to illustrate the nature of the detent pin utilized in the present invention. The detent pin (7) is housed in the detent retraction hole (3) of the anchor pivot plate (5). The detent pin (7) first end is permanently attached to the second end of the retraction cable (4) and has a detent retraction spring (6) positioned such that when the retraction cable (4) is operated (by pulling the ring-pull), the detent pin (7) moves fully inside the detent retraction hole (3). Conversely, when the retraction cable (4) is released (by releasing the ring-pull), the detent pin (7) second end will be forced under the pressure of the in-tension detent retraction spring (6) to impinge upon the inner surface of the fin arm first end (36), such that when a detent locking hole (15) is in alignment with the detent retraction hole (3), the detent pin (7) second end will be inserted into the detent locking hole (15), locking the fin assembly in place.

Assembly and Operation of the Scuba Diving Fin

To assemble the fin assembly, the fin blade (16) is attached to the fin arms (12) by inserting the fin arms (12) into the corresponding fin blade longitudinal slots (34). The fin attachment devices (14) are depressed so as the fin arms can be inserted further into the longitudinal slots (34) until the fin attachment devices (14) align with and then enter under pressure from the spring bias, the fin blade holes (35), whereupon the fin blade (16) becomes locked onto the fin arms (12). The fin blade can be removed by operating the fin attachment devices (14), which in our preferred embodiment is depressing the spring-biased buttons, which in turn release the fin arms (12), allowing the fin blade (16) to be slid off of the fin arms (12). When assembled as described above, the fin assembly (9) position relative to the boot assembly (8) may be adjusted via operation of the fin adjustment mechanism assembly (10). To assemble the fin adjustment mechanism assembly (10), the fin arm first end is attached to the anchor pivot plate (5) by inserting the anchor pivot spindle (2) through the pivot hole (17), and attaching the lock nut to the spindle (2). This assembly procedure is conducted for each fin adjustment mechanism assembly (10) as, of course, there is one each located on either side of the boot assembly (8). To operate the fin adjustment mechanism (10) and fin assemblies (9), the ring-pull is operated to pull the retraction cables (4), which in turn, pull the detent pins (7) fully into their respective detent retraction holes (3). The fin assembly can then be rotated about the axis of the anchor pivot spindle (2) freely, until the desired fin assembly (9) position is reached, and the retraction cables (4) are released, which in turn, allows the detent pin (7) second ends to enter the detent locking hole (15) that is aligned with the appropriate detent retraction hole (3). The fin assembly can be unlocked and rotated to another position by reversing the steps outlined above.

It should be recognized that the foregoing describes a single embodiment of the invention and that the practice of the invention can be achieved in a variety of ways. The scope of the present invention is intended to include such other ways.

What is claimed is:

1. A scuba diving fin, comprising:

(a) a boot assembly, said boot assembly having an enclosure for the foot, ankle and lower calf, wherein said enclosure has a rigid rear shell, a rigid front shell, and a flexible lower section;

(b) a fin adjustment mechanism attached to each side of said boot assembly;

(c) a fin assembly including two fin arms, one each said fin arms being rotatably attached to one of each said fin adjustment mechanisms;

(d) a fin blade attached intermediate to said two fin arms;

(e) a fin position release mechanism attached to said boot assembly, positioned intermediate to said fin adjustment mechanisms, having a ring-pull connected to two retraction cables.

2. The scuba diving fin of claim 1, wherein said rigid front shell and rigid rear shell enclose the diver's lower calf and ankle.

3. The scuba diving fin of claim 2, wherein said rigid front shell and rigid rear shell provide means for support to diver's lower calf and ankle during operation of scuba diving fin.

4. The scuba diving fin of claim 3, wherein said rigid front shell and rigid rear shell have means for attachment to one another, closure and locking and unlocking and opening of said rigid front shell and rigid rear shell.

5. The scuba diving fin of claim 4, wherein said flexible lower section encloses the diver's foot.

6. The scuba diving fin of claim 5, wherein said flexible lower section is permanently attached to said rigid front shell and rigid rear shell.

7. The scuba diving fin of claim 6, wherein said fin adjustment mechanism includes means to lock said fin arm at pre determined positions.

8. The scuba diving fin of claim 7, wherein said fin adjustment mechanism includes means to unlock fin arm.

9. The scuba diving fin of claim 8, wherein one of said pre determined positions coincides with said fin assembly located in same plane as diver's leg.

10. The scuba diving fin of claim 9, wherein one of said pre determined positions coincides with said fin assembly located behind diver's calf.

11. The scuba diving fin of claim 10, wherein said fin arms have means to rotate about the longitudinal axis of said fin adjustment mechanisms between said pre determined positions.

12. The scuba diving fin of claim 11, wherein said fin blade is detachable from said fin arms.

13. The scuba diving fin of claim 12, wherein said means for attachment to one another, closure and locking, unlocking and opening, of said rigid front shell and rigid rear shell is one or more ski-boot type adjustable latching systems.

14. The scuba diving fin of claim 13, wherein said means to lock said fin arm at pre determined positions is a detent pin and detent locking holes.

15. The scuba diving fin of claim 14, wherein said means to unlock fin arm is said ring-pull connected to two retraction cables.

16. The scuba diving fin of claim 15, wherein said retraction cables are each attached to one of two detent pins.

17. The scuba diving fin of claim 16, wherein said detent pins have means of entering said detent lock hole.

18. The scuba diving fin of claim 17, wherein said flexible lower section is a diving/scuba bootie.

19. The scuba diving fin of claim 18, wherein said fin blade can be detached from said fin arms and replaced with said fin blade of different length.

20. The scuba diving fin of claim 19, wherein said fin blade has an integrated carrying handle.

* * * * *